US005199702A

United States Patent [19]

Davis et al.

[11] Patent Number: 5,199,702

[45] Date of Patent: Apr. 6, 1993

[54] SHEET TRANSPORT APPARATUS

[75] Inventors: Timothy M. Davis, Macedon; John H. Looney, Fairport, both of N.Y.

[73] Assignee: Xerox Corporation, Stamford, Conn.

[21] Appl. No.: 858,264

[22] Filed: Mar. 26, 1992

[51] Int. Cl.[5] ..... B65H 5/06

[52] U.S. Cl. ..... 271/274; 271/272; 271/314

[58] Field of Search ..... 271/272, 273, 274, 314; 198/836.2, 624

[56] References Cited

U.S. PATENT DOCUMENTS

| | | | |
|---|---|---|---|
| 4,188,025 | 2/1980 | Gusfafson et al. | 271/314 |
| 4,368,881 | 1/1983 | Landa | 271/122 |
| 4,928,127 | 5/1990 | Stemmle | 346/160 |

FOREIGN PATENT DOCUMENTS

| | | | |
|---|---|---|---|
| 280060A | 8/1988 | European Pat. Off. | 271/272 |

OTHER PUBLICATIONS

IBM Technical Disclosure Bulletin vol. 23, No. 6, Nov. 1980, pp. 2228-2229.

*Primary Examiner*—H. Grant Skaggs
*Assistant Examiner*—Carol Lynn Druzbick

[57] ABSTRACT

Sheet transport apparatus has a pair of driven transport rolls and a pair of associated idler nip rolls forming sheet transport nips therebetween and defining a sheet transport path, one of the pair of transport rolls and pair of idler rolls being fixedly supported in a sheet feed table, the other of the pair of transport rolls and pair of idler rolls being mounted on a shaft which is pivotally mounted about an axis perpendicular to the shaft and parallel to the sheet feeding path, the shaft being pivotally mounted at the midpoint between the pair of rolls in a pivot housing extending across the sheet feeding path, one end of the pivot housing fixedly engaging the sheet feed table and including a spring to bias the other end of the pivot housing toward the sheet feed table to enable the shaft to pivot about the axis to provide the same nip force between each of the driven transport roll and its associated idler nip roll.

8 Claims, 4 Drawing Sheets

SHEET TRANSPORT APPARATUS

CROSS REFERENCE TO RELATED APPLICATION

Attention is directed to U.S. application Ser. No. 07/858,262 entitled "Corrugated Fang For Multimedia Feeder" by Sheridan et al. filed concurrently herewith.

BACKGROUND OF THE INVENTION

The present invention relates to sheet transport apparatus and in particular to a sheet transport apparatus which prevents skewed sheet feeding.

There are a variety of sheet separators, feeders and transport apparatus in use today. While some are designed for dedicated feeding of a particular kind of stock as defined by size and weight, for example, others must accommodate a broad range of materials, ranging from various weights and sizes of ordinary paper to card stock, labels and envelopes. It is to the latter type of device requiring great latitude in the range of materials that must be transported to which the present invention relates. One of the problems in such devices is the transport of sheets from one location to a downstream location such that the sheet is skewed from the beginning to the end of the transport path resulting in misregistration and even causing jams. One way to minimize this propensity for the skewing of sheets being fed is to space the feed rolls as far apart as possible to insure that both sides of the sheet are fed the same distance. This geometry, however, is not possible in multimedia feeders which are feeding sheets of a variety of sizes including, for example, regular 8½"×11", legal size as well as much narrower size stock including cards, labels and envelopes. Accordingly, the feed rolls or feed nips must be spaced within the feeding dimension of such stock.

SUMMARY OF THE INVENTION

In accordance with a principle aspect of the present invention sheet transport apparatus capable of transporting a variety of sheet sizes and weights as well as card stock, labels, envelopes, transparencies, etc., which provides accurate delivery of the sheet, in terms of skew is provided.

In accordance with a further principle aspect of the present invention the sheet transport apparatus has a pair of driven transport rolls and a pair of associated idler nip rolls forming the transport nips therebetween and is provided with means to equalize the nip force between each of the driven transport rolls and its associated idler nip roll.

In accordance with a further aspect of the present invention one of the pair of transport rolls or pair of idler nip rolls is fixedly supported in the sheet feed table while the other pair of transport rolls or pair of idler rolls are mounted on a shaft, which is pivotally mounted about an axis perpendicular to the shaft and parallel to the sheet feeding path, the shaft being pivotally mounted at the midpoint between the pair of rolls in a pivot housing extending across the sheet feeding path with one end of the housing having means to fixedly engage the sheet feed table and including means to bias the other end of the pivot housing toward the sheet feed table to enable the shaft to pivot about the pivot axis to provide the equalized nip force.

In accordance with a further aspect of the present invention, the driven transport rolls are fixedly supported in the feed table and the idler rolls are mounted on the pivotally mounted shaft.

In a further aspect of the present invention the shaft is pivotally mounted to a pivot block in the pivot housing.

In a further aspect of the present invention the transport rolls are deformable to the same degree and have the same shape and circumference in the undeformed state.

In a further aspect of the present invention the sheet transport apparatus includes a side registration edge along the feed table and the transport nips between the transport rolls and the idler nip rolls are adjacent to the side registration edge.

DETAILED DESCRIPTION OF THE INVENTION

Figure 1:
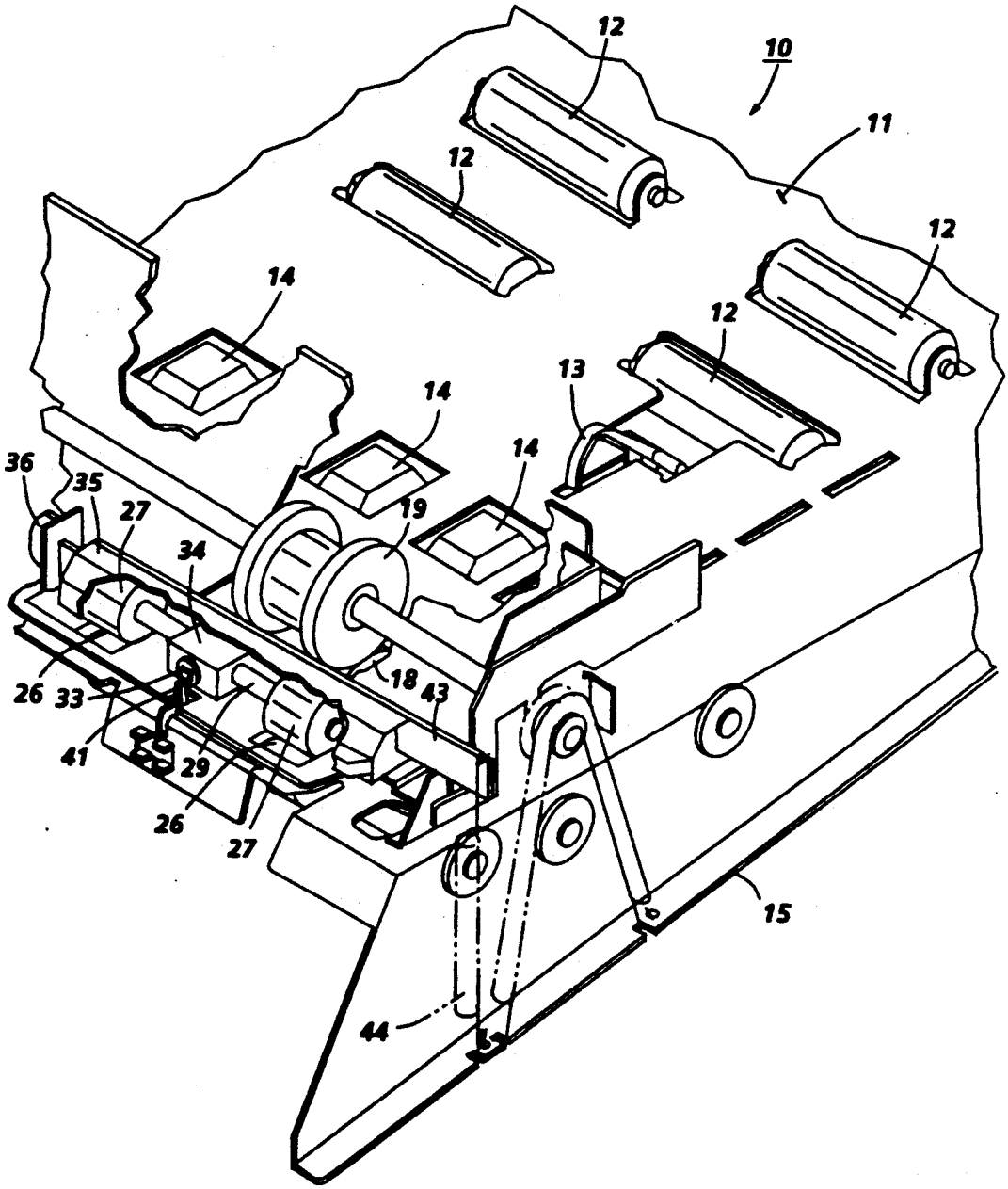
FIG. 1 is an isometric view of a multimedia feeder with the sheet transport apparatus according to the present invention.
Figure 2:
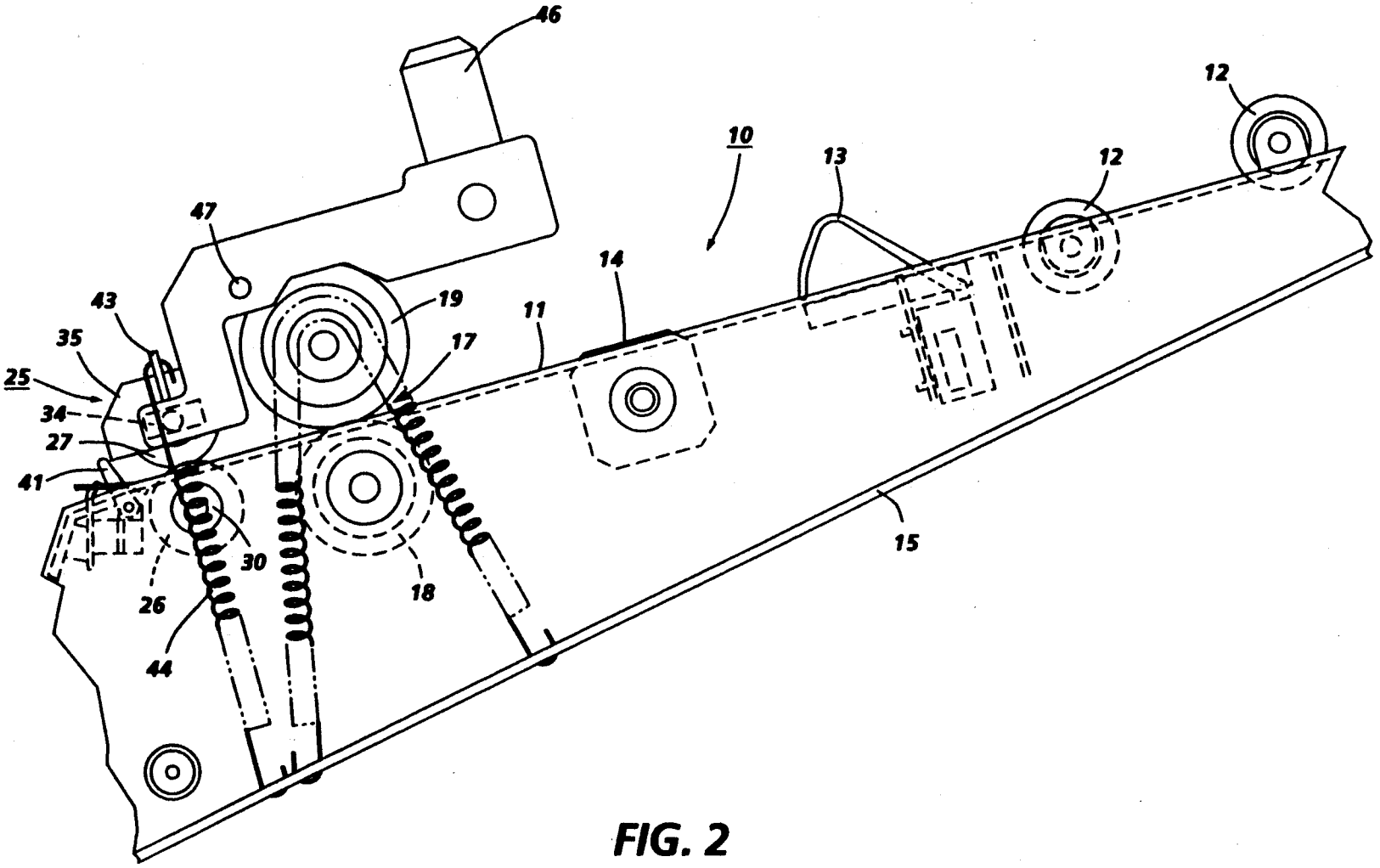
FIG. 2 is a side view of the multimedia feeder with the sheet transport apparatus according to the present invention.

Attention is directed to FIGS. 1 and 2 for a description of the multimedia sheet feeder including the sheet transport apparatus according to the present invention.

As used herein, the term "sheet" is intended to define not only sheets of ordinary paper of various sizes and weights but also to include a broad range of material such as card stock, labels, transparencies as well as envelopes, etc., which may be fed along a narrow dimension and which may also comprise more than one thickness of paper.

Attention is now directed to FIGS. 1 and 2, wherein a multimedia feeder is generally depicted for feeding sheets of different characteristics to a further processing station which may be a copier or printer, such as that, for example, illustrated in U.S. Pat. No. 4,928,127 to Stemmle, which is hereby incorporated by reference herein in its entirety. In the printer illustrated in the FIGURE in U.S. Pat. No. 4,928,127 the multimedia feeder is placed on the right side of the printer processor and feeds sheets directly to the registration pinch roll pair 78. The multimedia feeder 10 has a sheet feed table generally illustrated at an angle of about 30 degrees to the horizontal. In the sheet feed table are a series of stack support rolls 12 together with a switch 13 which is used to detect the presence of a sheet on the platform and send a signal to a suitable control mechanism (not shown) that a sheet is present on the sheet feed table and can be fed. A series of squareish shaped nudger rolls 14 are provided, which, in addition to their normal function of pre-separating and urging the bottom sheet forward also provide an impact force by virtue of its shape to drive the bottom sheet forward. The multimedia feeder is supported by a frame 15 and has an active friction retard sheet separator feeder 17 comprising a feed roll 18 and a retard roll 19 and which may serve to separate successive sheets and feed them in the manner described, for example, in U.S. Pat. No. 4,368,881 to Landa, which is hereby totally incorporated herein by reference.

Figure 3:
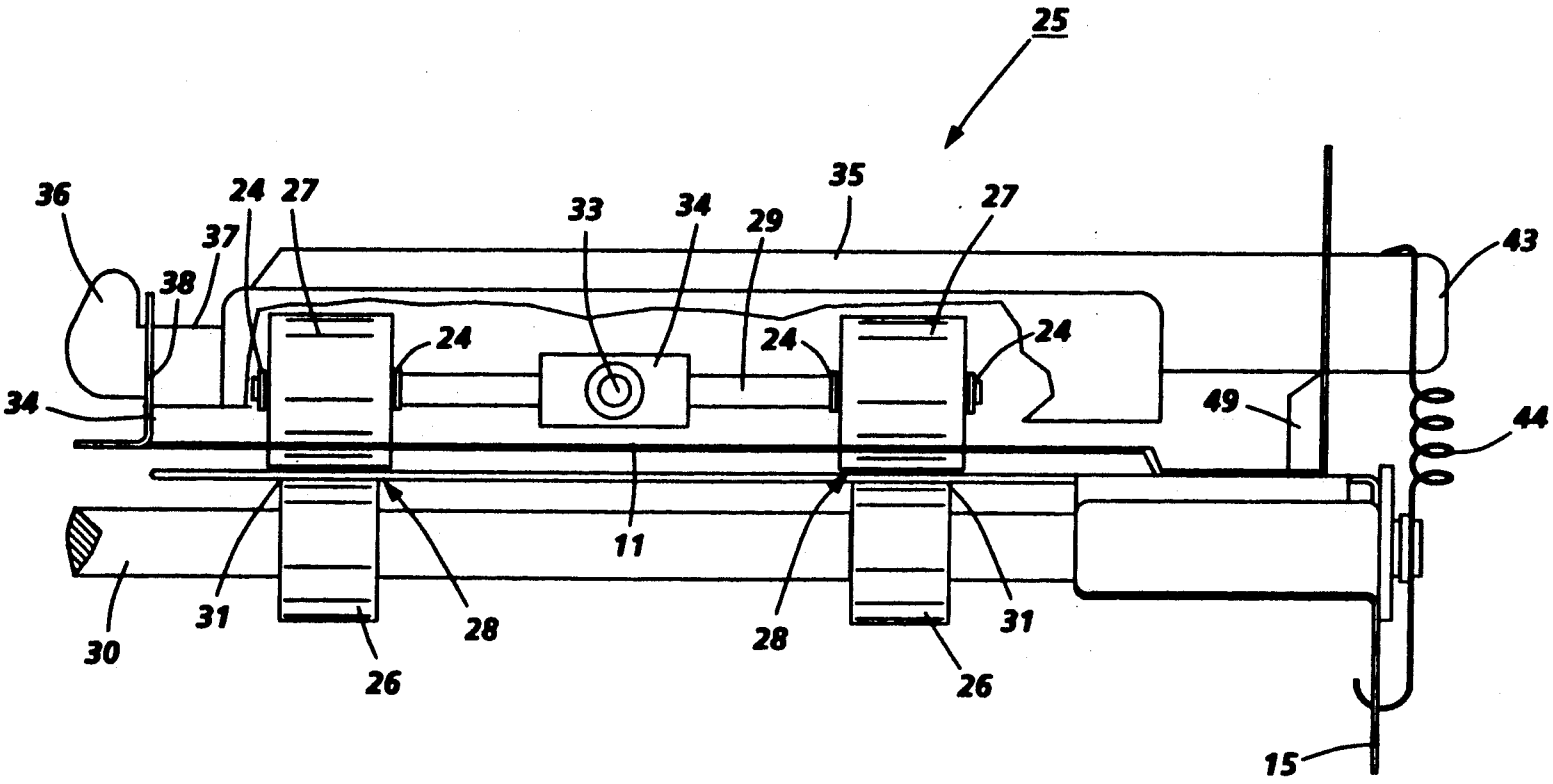
FIG. 3 is a schematic representation in cross section of the sheet transport apparatus according to the present invention.
Figure 4:
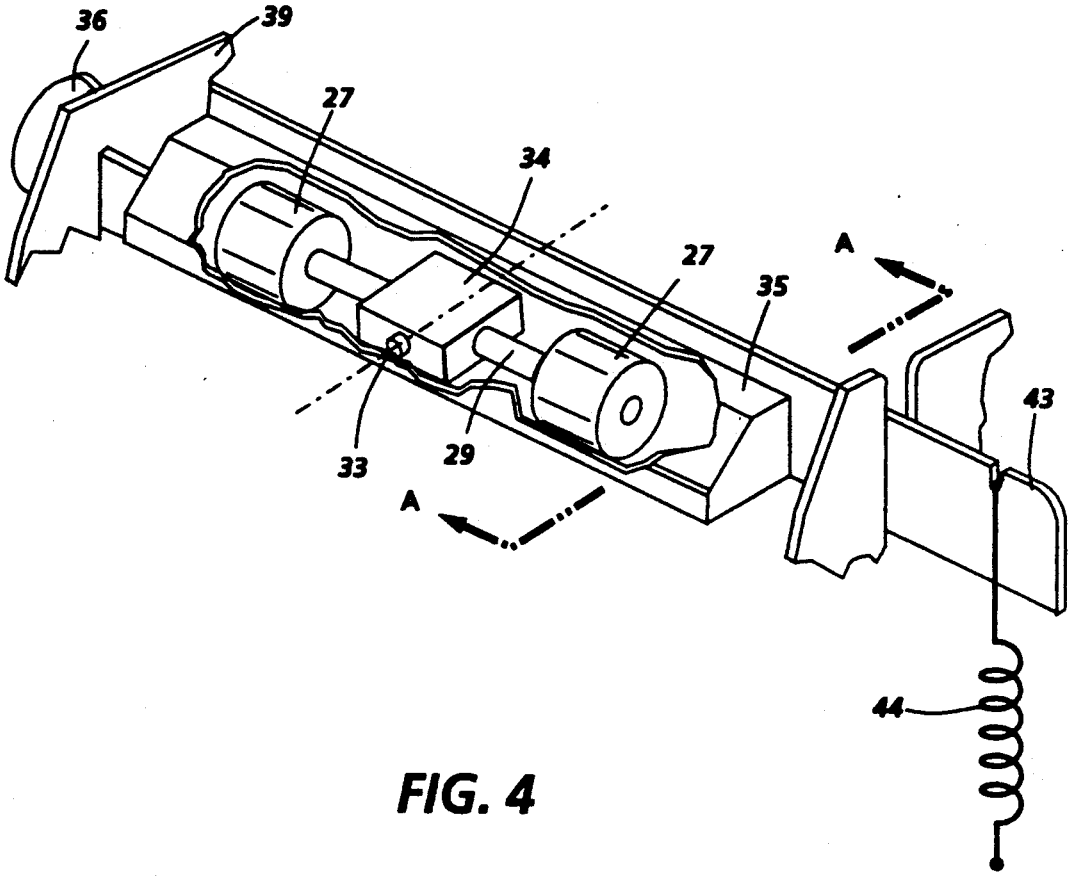
FIG. 4 is an isometric view of the sheet transport apparatus according to the present invention.
Figure 5:
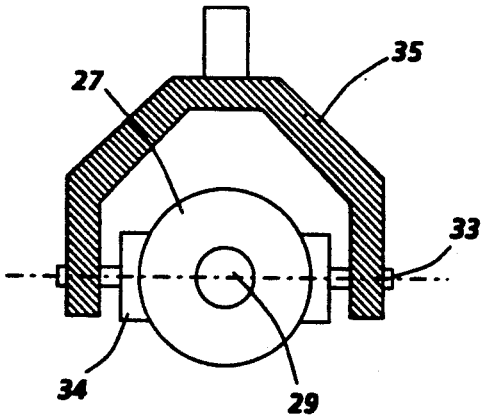
FIG. 5 is a cross sectional view taking along the lines AA in FIG. 4 of the transport apparatus according to the present invention.

With further reference to FIGS. 3, 4 and 5 the sheet transport apparatus 25 will be described in greater detail. A pair of driven transport rolls 26 are mounted on drive shaft 30 which is fixedly mounted in frame 15 and driven by means (not shown). The pair of driven transport or take away rolls are each associated with an idler nip roll 27 being positioned opposite each of the driven transport rolls and in contact therewith forming a transport nip 28 therebetween. The idler nip rolls 27 are securely mounted by retaining rings 24 on shaft 29 which in turn is mounted on pivot axis 33 in pivot mounting block 34 which is fastened to pivot housing 35. The pivot axis is perpendicular to the shaft supporting the idler nip rolls and parallel to the sheet feeding path through the sheet transport apparatus. The pivot axis is also positioned midway between the pair of idler nip rolls to provide equal force to each of the rolls thereby insuring nonskewed transportation. The pivot housing extends across the sheet feeding path with one end being fixedly engaged to the sheet feed table by means of a mounting hook 36 on the end of arm 37 extending from the end of the pivot housing which engages a slot 38 in vertical arm 39 which attaches to the frame. At the opposite end of the pivot housing and arm 43 is connected to a spring 44 the other end of which it is attached to frame 15 to bias that end of the pivot housing toward the sheet feed table 11. There is an exit switch 41 (See FIG. 2) at the output end of the sheet transport nip to detect the lead edge of a sheet as well as the passage of the trail edge and send a signal to a suitable control mechanism (not shown) operating the feeder and subsequent processing station. In addition, there is a nip release lever 46 pivotally mounted about pivot pin 47 and engagable with the pivot housing 35 to release the spring force and free the idler rolls from the nip.

In operation, a stack of sheets which may be of the same material or of mixed and different materials is placed on the sheet feed table 11 where its presence is detected by switch 13. The stack of sheets is placed on the sheet feed table with one side registered against side registration edge 49. At a suitable point in time the multimedia feeder is activated and the nudger rolls are rotated to pre-separate and urge the bottom sheet forward into the separating nip of the active friction retard feeder assembly 17. The lead edge of the sheet being fed is captured by the sheet transport nip 28 formed between the driven transport roll 26 and idler nip roll 27 and transported there through with the lead edge being detected by exit switch 41. With the idler rolls being pivotally mounted midway between their positions relative to the drive transport rolls and the pivot housing being biased toward the sheet feed table, the feeding force between both idler rolls and the driven rolls is the same and the sheet will be transported through the nip and sheet feed path without being skewed. To insure this, the driven transport rolls are slightly deformable, being made of a natural or synthetic material such as EPDM elastomer, ethylenepropylene terpolymer, and in the undeformed state have the same shape and same circumference. As a result, each of the feed rolls are slightly deformed to the same degree in the feeding nip with the idler rolls and provide equal drive distance to the sheet being fed during one revolution. In this way the nip forces between each of the driven transport roll and idler roll are equalized and a consistent and uniform force is provided to prevent skewed feeding.

Thus, according to the present invention a relatively simple sheet transport system for use in an asymmetrical feed system has been provided which provides self-adjusting and equal forces on each of the driven transport or take away roll pairs. This is provided by pivotally mounting the idler nip rolls on a shaft midway between each of the idler nip rolls and biasing, by means of a spring, for example, the pivot housing containing the pivotable idler nip rolls toward the sheet feed table containing the driven transport rolls. The forces between the driven transport or take away rolls and idler nip rolls are equalized by virtue of the idler nip rolls being mounted at their center point. If they are not so mounted unequal forces will be present in the two nips between the transport rolls and idler rolls which will result in a skewed feeding.

The patents and patent applications referred to herein are hereby specifically and totally incorporated herein by reference.

While the invention has been described with reference to specific embodiments it will be apparent to those skilled in the art that many alternatives, modifications and variations may be made. For example, while the invention has been described with reference to the driven transport or take away rolls being fixedly mounted in the sheet feed table it will be understood that the idler rolls could be fixedly supported in the feed table and the driven rolls be in the pivot housing. Accordingly, it is intended to embrace all such alternatives and modifications as may fall within the spirit and scope of the appended claims.

We claim:

1. Sheet transport apparatus comprising a pair of driven transport rolls and a pair of associated idler nip rolls forming sheet transport nips therebetween and defining a sheet transport path, one of said pair of transport rolls and pair of idler rolls being fixedly supported in a sheet feed table, the other of said pair of transport rolls and pair of idler rolls being mounted on a shaft which is pivotally mounted about an axis perpendicular to the shaft and parallel to the sheet feeding path, said shaft being pivotally mounted at the midpoint between said pair of rolls in a pivot housing extending across the sheet feeding path, one end of said pivot housing having means to fixedly engage said sheet feed table and including means to bias the other end of said pivot housing toward said sheet feed table to enable said shaft to pivot about said axis to provide the same nip force between each of said driven transport rolls and its associated idler nip roll.

2. Sheet transport apparatus of claim 1 wherein the driven transport rolls are fixedly supported in said feed table and the idler rolls are mounted on said pivotally mounted shaft.

3. Sheet transport apparatus of claim 1 wherein said shaft is pivotally mounted to a pivot block in the pivot housing.

4. Sheet transport apparatus of claim 1 wherein said transport rolls are deformable to the same degree and have the same shape and circumference in the undeformed state.

5. Sheet transport apparatus of claim 1 further including a frame and wherein said means to bias is a spring connecting said other end of the pivot housing to said frame.

6. Sheet transport apparatus of claim 5 including means to release the spring force urging the idler rolls and driven transport rolls together.

7. Sheet transport apparatus of claim 1 wherein said one of end of the pivot housing fixedly engages the feed table by means of a mounting hook on said pivot housing engaging a mounting slot in a vertical arm extending upwardly from said feed table.

8. Sheet transport apparatus of claim 1 including a side registration edge along one edge of said feed table and wherein said transport nips between said driven transport rolls and said idler nip rolls are adjacent to said side registration edge.

* * * * *